US005471791A

United States Patent [19]

Keller

[11] Patent Number: 5,471,791

[45] Date of Patent: Dec. 5, 1995

[54] MOBILE PARTITION WALL

[75] Inventor: Otto Keller, Villmergen, Switzerland

[73] Assignee: Rosconi AG, Villmergen, Switzerland

[21] Appl. No.: 246,821

[22] Filed: May 20, 1994

[30] Foreign Application Priority Data

May 25, 1993 [CH] Switzerland ..... 01 570/93

[51] Int. Cl.[6] ..... E06B 7/28

[52] U.S. Cl. ..... 49/317; 49/127; 52/64; 52/243.1; 160/40

[58] Field of Search ..... 49/127, 125, 317, 49/316, 409; 52/241, 64, 243.1; 160/40

[56] References Cited

U.S. PATENT DOCUMENTS

| | | | |
|---|---|---|---|
| 3,072,975 | 1/1963 | Burmeister | 49/317 |
| 3,126,050 | 3/1964 | Lapof | 49/316 X |
| 3,280,526 | 10/1966 | Pepitone | 49/127 X |
| 3,295,257 | 1/1967 | Douglass | 49/127 X |
| 3,462,792 | 8/1969 | Greco | 49/127 X |
| 3,748,793 | 7/1973 | Tompkins et al. | 52/243.1 X |
| 4,454,690 | 6/1984 | Dixon . | |
| 4,535,578 | 8/1985 | Gerken | 49/317 X |

FOREIGN PATENT DOCUMENTS

| | | | |
|---|---|---|---|
| 948982 | 6/1974 | Canada . | |
| 0471596 | 2/1992 | European Pat. Off. . | |
| 2404875 | 8/1975 | Germany . | |
| 2653328 | 12/1977 | Germany | 49/127 |
| 4225849 | 9/1993 | Germany . | |
| WO83/00182 | 1/1983 | WIPO . | |

*Primary Examiner*—Philip C. Kannan
*Attorney, Agent, or Firm*—W. G. Fasse; W. F. Fasse

[57] ABSTRACT

A mobile partition wall includes a plurality of adjoining wall elements 1. In order to prop and stabilize each wall element 1 between the ceiling and the floor and to provide noise insulation, each wall element includes an upper seal bar 8 and a lower seal bar 9. The seal bars 8, 9 cooperate with a pneumatic stroke or force device 20 via a linkage 16, 16'. The stroke device 20 preferably includes a pneumatic bellows. A pneumatic coupling is arranged on each of the two narrow vertical edges of each wall element 1. When adjacent wall elements are pushed against one another, the respective adjacent couplings engage or couple with one another, whereby a non-return or poppet-type valve is opened to allow the flow of pressurized air. The pressurized air actuates the stroke device 20, which extends the seal bars 8, 9 outwardly to press against the upper support track and the floor.

12 Claims, 4 Drawing Sheets

MOBILE PARTITION WALL

FIELD OF THE INVENTION

The invention relates to a mobile partition wall having separate wall elements that each hang from and may be moved along a support track mounted on the ceiling of a room, wherein each wall element has at least one seal member for achieving a seal when the wall element is in a deployed position.

BACKGROUND INFORMATION

Mobile partition walls are generally known for dividing a room into separate spaces or configurations as desired. Separate wall elements or panels hang from a support track, which is mounted on the ceiling of the room. Each panel is slidable along the support track to be moved into a deployed partition position or to be moved into a storage position in which the separate wall elements are stacked together into a small space.

In order to insure that the separate wall elements are easily slidable along the support track, it is necessary to provide clearance gaps between the lower edge of the wall element and the floor and between the upper edge of the wall element and the ceiling. Because noise easily passes through the clearance gaps, typical mobile partition walls have the disadvantage of an unsatisfactory noise insulation or sound damping. Furthermore, air drafts, smoke, food odors, light, etc. also pass through the clearance gaps.

As a further disadvantage, the prior art wall elements are not very stable when they are merely hanging from the ceiling-mounted support rail. For this reason, a floor track or floor groove is typically provided to guide and support the lower edge of each wall element as it is pushed along the guide track and also to provide the necessary vertical stability for each wall element in its final deployed position.

As an attempt to reduce or avoid the above described disadvantages, it is already known to provide seal members such as seal bars for the separate wall elements, wherein the seal bars are mechanically pressed and clamped into the seal position. In such a mechanical arrangement, it is inconvenient and complicated to engage and disengage the mechanically activated seal bars, especially when the partition wall is frequently deployed and stored or reconfigured.

OBJECTS OF THE INVENTION

In view of the above, it is the aim of the invention to achieve the following objects singly or in combination:

to provide a particular construction of a wall element for a mobile partition wall that achieves an improved noise insulation and an improved stability when the wall elements are fixed in a deployed position;

to avoid the need of a floor guide track or groove for such a mobile partition wall;

to provide the necessary ceiling and floor clearance gaps in such a mobile partition wall while the wall elements are sliding into position;

to provide a respective seal bar along a top edge and along a bottom edge of each wall element to close the clearance gaps when the wall element is in the final deployed position;

to provide a pneumatically activated mechanism in each wall element that automatically moves the seal bars into the sealed position when the wall element is placed in its final deployed position;

to provide such a wall element, wherein the sealing and stabilizing function may be quickly and easily activated and deactivated as desired; and to provide such a wall element, wherein the desired sealing and stabilizing function is achieved by the two seal bars independently of the weight and height of a wall element, and even, for example, for relatively heavy and tall wall elements.

SUMMARY OF THE INVENTION

The above objects have been achieved in a mobile partition wall having wall elements according to the present invention, wherein each wall element has a lower seal bar and an upper seal bar. Each respective seal bar is arranged to be height adjustable relative to the wall element, whereby the lower seal bar can be pressed outwardly from the wall element to seal against the floor while the upper seal bar can be pressed outwardly from the wall element to seal against the ceiling-mounted guide track, for example. The two seal bars of each wall element are operatively connected to at least one vertically effective, pneumatically actuatable stroke device.

A respective pneumatic coupling member is provided on each of the two vertical narrow sides of each wall element. The two coupling members are, for example, a male and a female member and are arranged to engage one another when adjacent wall elements are pushed tightly against one another. At least one of the two coupling members on each wall element includes a poppet-type valve or nonreturn valve. Each of the coupling members is interconnected, for example, by pressure tubing, to provide a pneumatic interconnection among the valves and the pneumatic stroke device. Thus, when a plurality of wall elements is pushed together to form a partition wall, all of the coupling members and pneumatic stroke devices are pneumatically interconnected. At one end of the partition wall, a source of compressed air is connected to one coupling member, while at the other end of the partition wall, a nonreturn or poppet-type valve prevents leaking of the compressed air.

With this arrangement according to the invention, it is easy to push or slide the separate wall elements along the support track to the final deployed position, and then to activate the pneumatic stroke devices arranged in the wall elements so as to extend the seal bars and achieve a good stability and a high level of noise insulation. Moreover, the pneumatic actuation of the stroke devices may be simply and automatically carried out in an effortless manner merely by pushing together the respective adjacent wall elements. It is a further advantage that all of the stroke devices of all of the wall elements are provided with compressed air from a common compressed air source that can be permanently arranged at a remote location within the building.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS OF THE INVENTION

Figure 1:
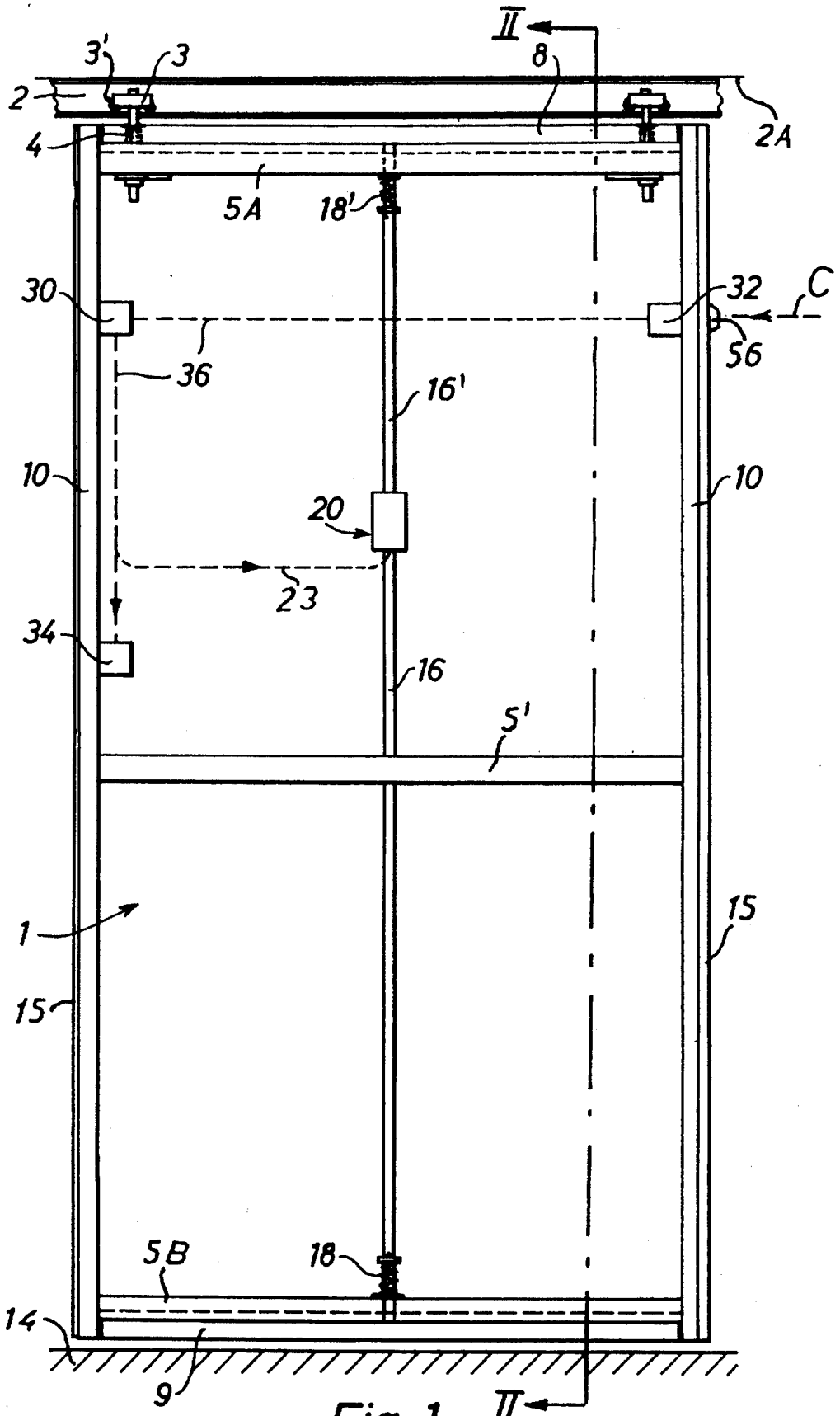
FIG. 1 is a schematic front view of a wall element according to the invention, with a front panel removed to show the various internal elements.
Figure 2:
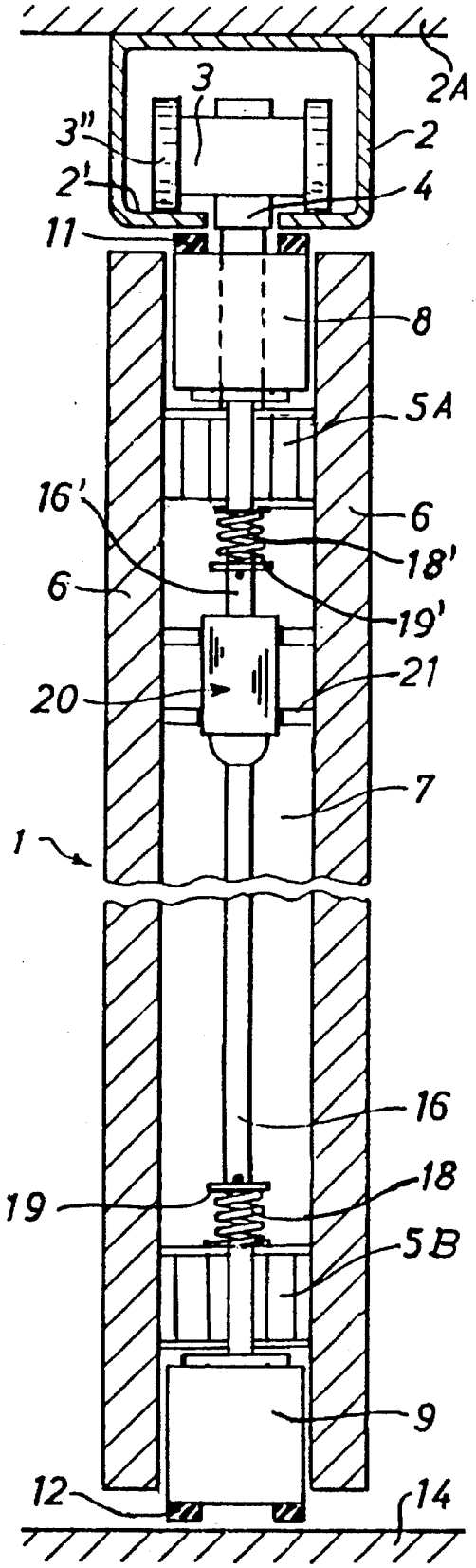
FIG. 2 is a cross-section through a wall element according to the invention, for example, the wall element of FIG. 1 taken along section line II—II, but with an alternative embodiment of a support carriage.
Figure 6:
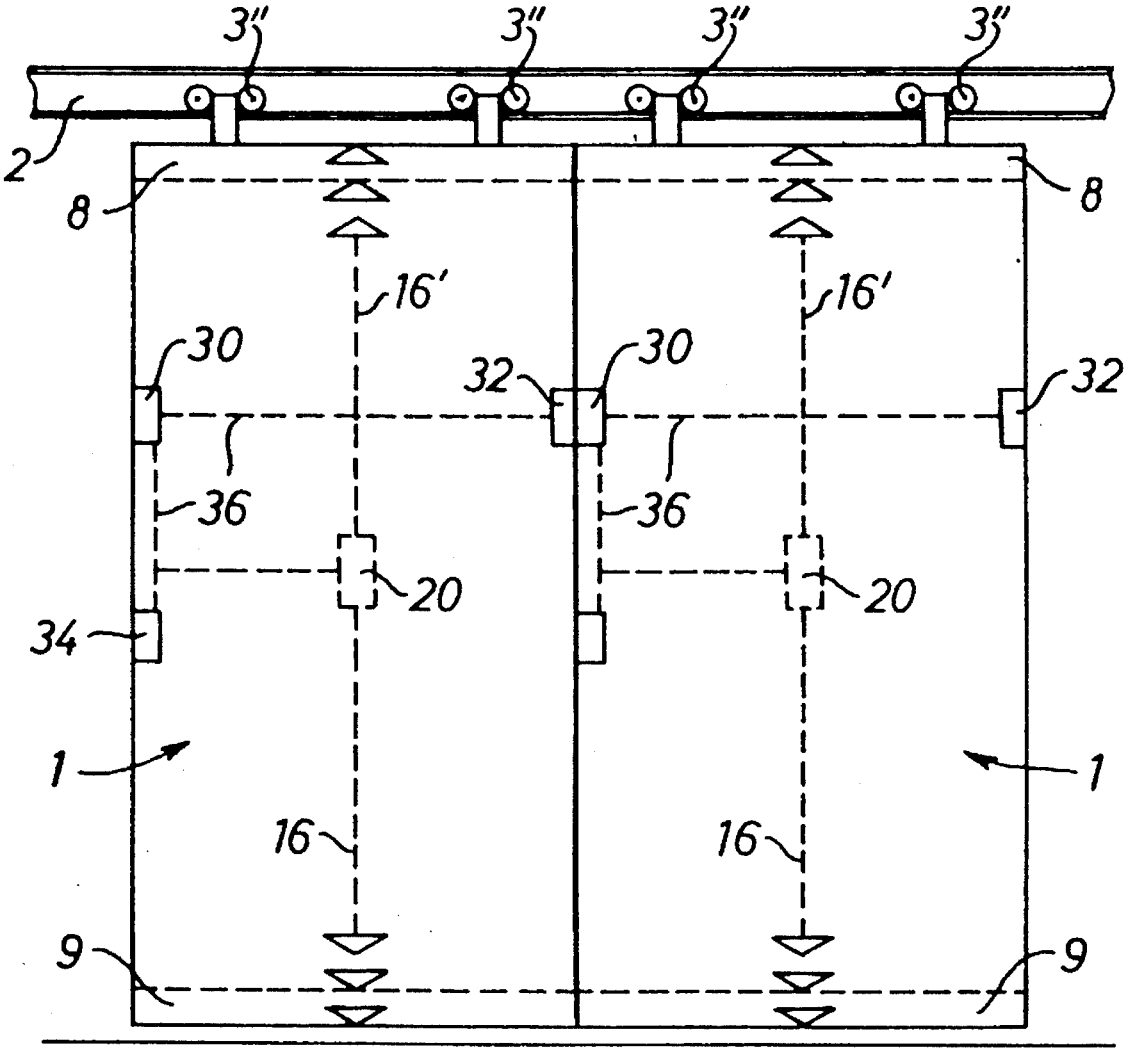
FIG. 6 is a schematic front view of a partition wall including a plurality of wall elements according to the invention.

A complete partition wall as represented in FIG. 6 is made up of several independent panel-shaped wall elements 1, shown in FIG. 1. The mobile partition wall system includes a support or guide track 2 mounted on the ceiling 2A of a room to be partitioned. Alternatively, the track 2 may be recessed in a corresponding groove in the ceiling 2A. Each wall element 1 hangs from the support or guide track 2. The guide track 2 is preferably a hollow sectional member having a C-shaped cross-section as shown in FIG. 2.

Each wall element 1 comprises preferably two support carriages 3 which are movably arranged within the C-shaped track 2. Each support carriage 3 may, for example, carry rolling balls such as ball bearings 3' as shown generally in FIG. 1, or may carry rolling wheels 3" as shown in FIG. 2. In either case, the rolling balls 3' or rolling wheels 3" easily roll along the inner rails 2' of the track 2. As a further alternative, the ball 3' or the wheel 3" may represent a fixed, low-friction gliding member such as a Teflon® member, which easily glides on the rails 2' in a low friction manner.

Each support carriage 3 is connected to the wall element 1 by a suspension member 4, such as a suspension strut 4, which is connected to a horizontal support member 5A that forms a part of the frame of the wall element 1. The frame structure of the wall element 1 further includes a lower horizontal frame member 5B and two vertical frame members 10, which are preferably sectional rail members 10, for example. The frame construction can be made of wood or metal, especially steel and/or aluminum. The frame structure may be further strengthened by a horizontal cross-brace 5'.

Each wall element 1 further includes two panels 6, which are held a certain interspacing 7 apart from one another and carried by the vertical frame members 10, for example. The panels 6 are preferably also rigidly connected to the horizontal support members 5A and 5B. Each panel 6 can be made of particular materials to meet the requirements of the particular application. For example, the panels 6 can be made of steel, aluminum, glass, plaster, wood, plastic or composite materials, such as fiberglass. Furthermore, each panel 6 may have a sandwich structure of several different plies or layers. It is also possible to construct panels 6 with a steel frame and glazing in particular areas or over the entire panel to provide respective windows.

Figure 4:
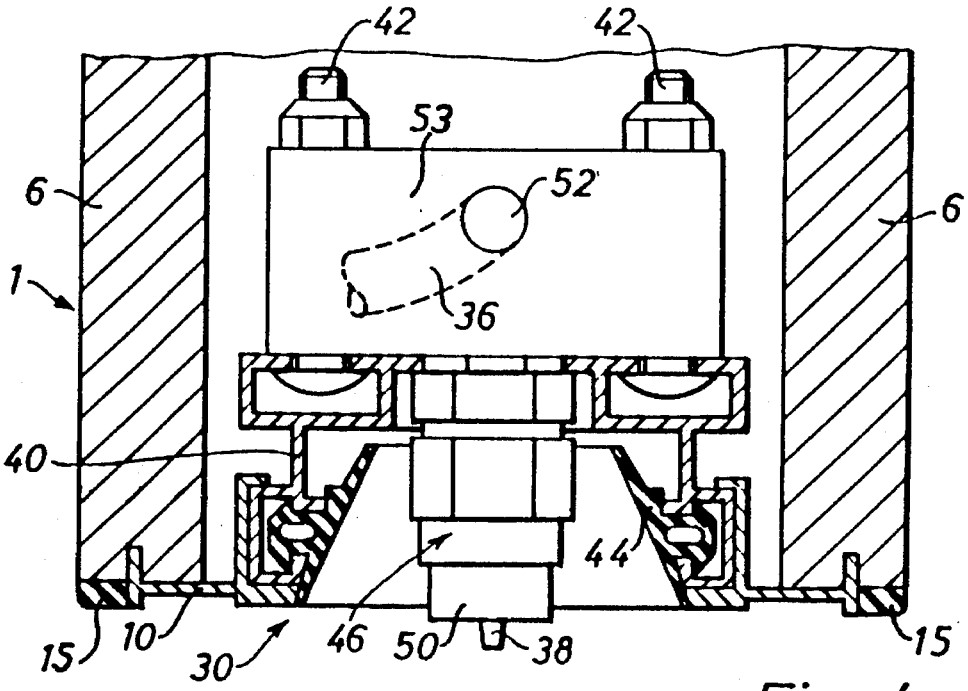
FIG. 4 is a view of a first pneumatic coupling member, shown partially in section.
Figure 5:
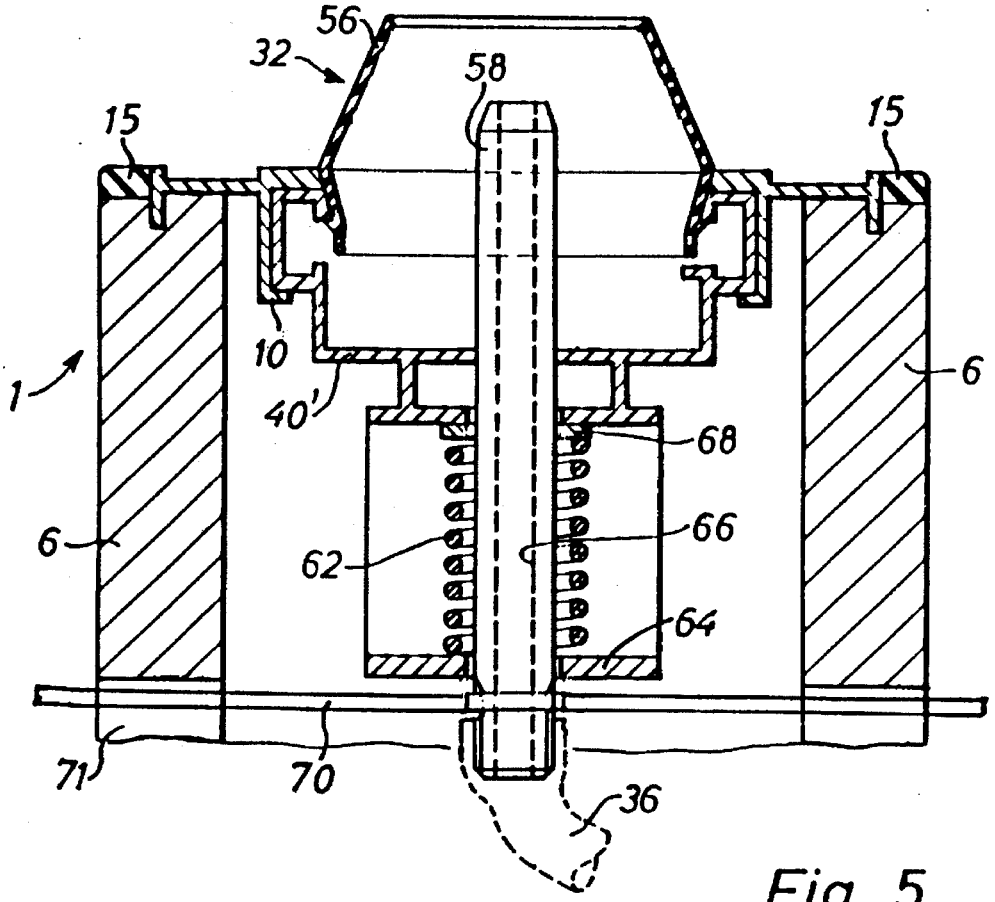
FIG. 5 is a view of a second pneumatic coupling member for engaging the coupling member shown in FIG. 4, also shown partially in section.

In order to form a seal between adjacent wall elements 1 when they are pushed together in the final deployed position, a buffer strip 15 is provided along the outer edge of each vertical frame member 10 as shown in FIG. 1 and in further detail in FIGS. 4 and 5. In order to seal the floor and ceiling clearance gaps and to tightly prop or clamp the wall element into its deployed position and thereby provide stability, a lower seal member or seal bar 9 is arranged at the bottom of the wall element 1 between the two panels 6, and an upper seal member or seal bar 8 is arranged at the top of the wall element 1 between the two panels 6.

Flexible seal strips 11 are arranged on the top of the upper rigid seal bar 8 as shown particularly in FIG. 2. The seal flexible strips 11 are arranged so as to be pressed against the support track 2 by the seal bar 8. Corresponding flexible seal strips 12 are arranged on the lower rigid seal bar 9 so that they can be pressed against the floor 14 by the seal bar 9.

The two seal bars 8 and 9 are interconnected by a linkage and actuator mechanism, including a stroke device 20, which is preferably a pneumatic device 20, and two rods 16 and 16' extending from the device 20 to the respective seal bars 9 and 8. Respective compression springs 18 and 18' are arranged on and around the rods 16, 16' at respective locations between the seal bar 9 and the pneumatic stroke device 20 and between the seal bar 8 and the pneumatic stroke device 20. As shown particularly in FIG. 2, a stop 19, 19', which is preferably in the form of a washer or a crosswise pin or a combination thereof, is arranged on each rod 16, 16'. The respective compression spring 18, 18' presses against the respective stop 19, 19' on the one hand and against the respective horizontal support member 5B, 5A on the other hand. In a resting state, the two compression springs 18, 18' are slightly precompressed between the respective stop 19, 19' and the respective horizontal support member 5B, 5A, whereby the springs 18, 18' constantly push on the respective rod 16, 16' to pull the respective seal bar 9, 8 into a non-sealing, retracted state shown in FIG. 2.

As shown in FIGS. 1 and 2, the pneumatically actuatable stroke device 20 is arranged within the interspace 7 between the two panels 6 of each wall element 1. The stroke device 20 is effective in a substantially vertical direction and is arranged and adapted to apply a vertically directed propping or expanding force to the two seal bars 8 and 9. The stroke device 20 is held or supported in the hollow interspace 7, for example by supports 21 as shown in FIG. 2.

Figure 3:
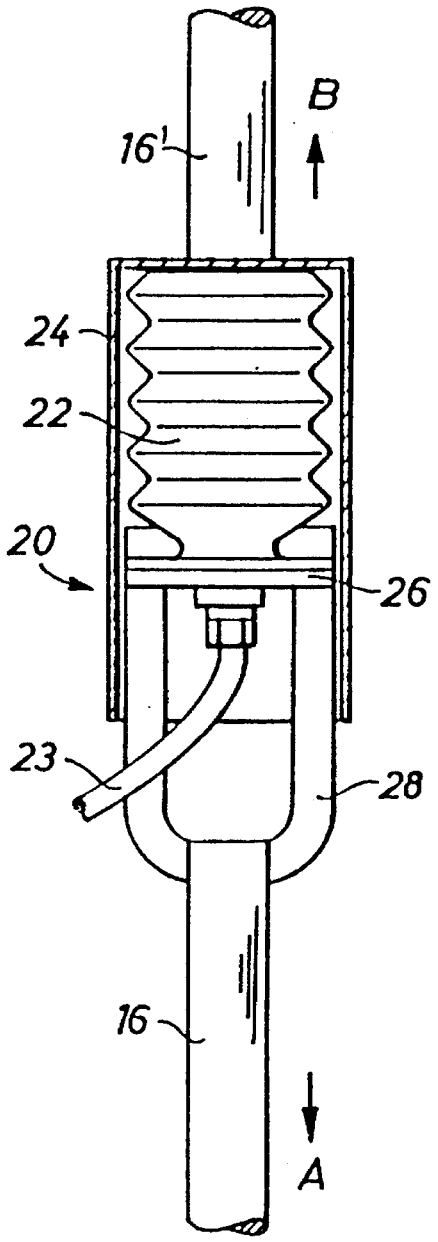
FIG. 3 is a schematic, enlarged, detail view of a stroke device comprising a pneumatic bellows.

As shown in detail in FIG. 3, the stroke device 20 preferably comprises a pneumatic bellows 22 with a vertical motion direction. A substantially cup-shaped housing 24 surrounds the bellows 22. A supporting disk or force disk 26 is movably supported within the housing 24 at one end of the bellows 22. A U-shaped yoke 28 is connected to the lower rod 16, and the free ends of the yoke 28 contact or are connected to the force disk 26. A pressure hose or pipe 23 opens into the interior of the bellows 22, for example, through a corresponding fitting provided on the force plate 26. When compressed air is provided through the pressure hose 23, the bellows expands and presses rod 16 in direction A and oppositely presses rod 16' in direction B. Thereby, rods 16 and 16' are pressed outwardly against the resistive force of respective springs 18, 18' so as to press the respective seal bar 9, 8 with its seal strips 12, 11 against the floor 14 or the support track 2, respectively. When air is allowed to vent from pressure hose 23, the compression springs 18, 18' retract the rods 16, 16' and compress or collapse the bellows 22.

As indicated schematically in FIG. 1, the pressure hose 23 (FIG. 3) is part of a compressed air supply line 36 which is connected to two pneumatic coupling members 30 and 32. The coupling members 30 and 32 are arranged opposite one another in the vertical narrow sides of the wall element 1, that is to say, they are arranged in the respective vertical frame members 10. The coupling members 30 and 32 are arranged and configured to cooperate or mate with one another, as will now be described with reference to FIGS. 4 and 5.

Referring to FIG. 4, the first coupling member 30 includes a non-return or poppet-type valve, which is generally known as such. The first coupling member 30 includes a protruding stem or pin 38, which cooperates with or is actuated by a protruding pin or bolt 58 of the other coupling member 32, which will be described below. In this manner, when the two coupling members 30 and 32 are coupled or engaged, the poppet-type valve of coupling member 30 is open and allows compressed air to flow through. On the other hand, when the coupling members 30 and 32 are disengaged or decoupled, the poppet-type valve of member 30 closes and stops the flow of compressed air.

The first coupling member 30 is attached by bolts or screws 42 to a carrier rail 40 which in turn is attached to the vertical frame member 10. The coupling member 30 includes an air chamber body 53 with an air supply opening 52, which is connected to a pressure hose or pipe 36. The coupling member 30 further includes a valve body 46, which is radially outwardly surrounded by a cone 44 made of an elastic material, which is also secured to the carrier rail 40. A valve element 50 is linearly or axially movable within the valve body 46 and cooperates with the pin or bolt 58 of the other coupling member 32 to open the throughflow passage for the compressed air.

Referring to FIG. 5, the second coupling member 32 is arranged on a carrying rail 40' mounted on the vertical frame member 10. A resilient or flexible sheath 56 preferably is made of an elastomer and has a substantially conical protruding shape corresponding to the conical shape of the cone 44 of the first coupling member 30. The sheath 56 is attached to the vertical frame member 10, for example. The coupling member 32 further comprises an axially or centrally located pin or bolt 58 having an axially extending air flow passage 66 therethrough. The bolt 58 is movably supported relative to the carrier rail 40' and is urged outward or upwards in FIG. 5 by the spring tension of a spring 62. The spring 62 is held against a rigid fixed support 64 and presses against an annular disk 68 connected to the bolt 58. At the lower end of the bolt 58 in FIG. 5, the air flow passage 66 opens into a pressure hose or pipe 36.

When two adjacent wall elements 1 are pushed against each other, the adjacent coupling members 30 and 32 cooperate so that the valve pin or bolt 58 presses onto the pin 38 and penetrates into the valve element 50, thereby achieving a tight seal and opening the valve to allow compressed air to flow into passage 66. Thus, the compressed air flows from the air chamber body 53 through the valve body 46, through the hollow pin 38, and then through the air flow passage 66 of bolt 58 into the pressure hose 36, and finally to the pneumatic stroke device 20. In order to achieve a tight-fitting and resilient seal, the spring-loaded bolt 58 yields against the spring force of spring 62 when the coupling members 30 and 32 are pushed together. The spring 62 compensates for tolerances between the coupling members 30 and 32.

When two adjacent wall elements 1 are separated, the non-return or poppet-type valve of the first coupling member 30 interrupts the throughflow of compressed air. Thus, air will not leak out and the proper air pressure is maintained in the wall elements still connected as a partition wall to a source of compressed air. On the other hand, compressed air freely flows out of the air flow passage 66 of the coupling bolt 58 of the wall element being removed so as to vent the compressed air from that wall element.

As shown in FIG. 1, at least one of the wall elements 1 has a manually operable decompression valve 34 well known in the art, that, when actuated, allows the compressed air to escape from the pneumatic stroke device 20. Due to this decompression, the two compression springs 18, 18' pull back the rods 16, 16' and thereby retract the seal bars 9, 8 away from the floor 14 and the supporting track 2 respectively.

FIG. 5 shows another optional element for carrying out the decompression of the pneumatic stroke device 20 of a particular wall element 1 so that the wall element 1 can be removed from the partition wall and moved away along the support track 2. Namely, a manually operable decoupling arm 70 is connected to the spring-loaded coupling bolt 58. The decoupling arm 70 extends radially outwardly from the bolt 58 in two directions and passes through a corresponding slot 71 provided in each of the panels 6. By manually pulling back the decoupling arm 70, the bolt 58 is retracted against the spring force of spring 62, whereby the bolt 58 disengages from the valve element 50 so as to shut off the flow of air from the coupling member 30 and allow air to escape through the air flow passage 66 of bolt 58. In this manner, the pneumatic stroke device 20 of a wall element 1 is decompressed and the seal bars 8 and 9 are retracted so that the wall element 1 may be easily moved away from the adjacent wall element.

In order to provide compressed air to the wall elements to form a partition wall, a vertical wall of the room is provided with a wall connection jamb having a pneumatic tap valve. This pneumatic tap valve is connected to a compressed air source, which is typically located in a fixed position in the building. For example, an air compressor may be located in almost any desired location within the building, for example in a physical plant room or in a ceiling niche. It is merely necessary to interconnect the air tap valve with the compressor by appropriate pressure hoses or pipes. In order to provide sufficient propping force to achieve good sound insulation and stability according to the invention, the compressor should provide pressurized air at preferably three to six bar.

The deployment of wall elements 1 to form a partition wall will now be described. A first wall element is pushed along the support track 2, for example toward the right in FIG. 1, until the vertical edge of the wall element 1 comes into contact with the wall connection jamb provided on the wall of the room. Thereby, the buffer strips 15 of the wall element 1 form a tight seal against the wall connection jamb and the coupling member 32 engages the air tap valve provided in the wall connection jamb. The air tap valve on the wall is configured as a non-return or poppet-type valve, for example having a structure similar to that of the first coupling member 30.

When the coupling member 32 engages the air tap valve, the valve opens and compressed air flows in the direction of arrow C (FIG. 1) into the pressure line 36. Thereby, the pneumatic stroke device 20, preferably comprising a pneumatic bellows 22, is filled with pressurized air and pushes the rods 16, 16' outwardly in opposite directions, namely directions A and B in FIG. 3. The rods 16, 16' outwardly press the two seal bars 9, 8 into the propping and sealing position, in which they tightly press against the respective floor 14 and upper support track 2. Thereby, the wall element 1 is securely propped between the floor and the ceiling and held in a fixed position.

Then, a next adjacent wall element is pushed along the support track 2 until it contacts the left vertical edge of the wall element 1 shown in FIG. 1. Thereby, the respective coupling elements 32 and 30 engage one another so that compressed air flows further from the wall air tap valve through the pressurized air lines 36 of the first wall element 1 and into the air lines 36 of the second wall element 1. The pressurized air expands the pneumatic stroke device 20 of the second or adjacent wall element 1 so that the seal bars 9 and 8 of the second or adjacent wall element 1 are pushed outwardly to seal and prop the second wall element against the floor and ceiling respectively. It is a simple matter to push additional wall elements sequentially one against another so that the above described process is repeated for each wall element.

FIG. 6 schematically shows two wall elements 1 that have been pushed together so that their adjacent coupling elements 32 and 30 have engaged each other. Once the wall elements are pushed against the fixed pneumatic tap valve provided on a room wall (not shown) as described above, the seal bars 8 and 9 will be extended to seal against the ceiling and the floor as represented by the triangular arrows in FIG. 6.

In the above described manner, each wall element is substantially automatically pressurized and brought into a sealed and stabilized condition merely by pushing it against the adjacent wall element. Thus, it is not necessary to provide a mobile source of compressed air that is separately or individually attached to each wall element. Because the entire partition wall, once assembled, forms a single sealed pneumatic system, the individual wall elements are independent of a compressor or other source of compressed air. When pressure is lost from any individual wall element, the other wall elements remain properly pressurized due to the non-return valve in the coupling member 30.

In order to disengage and retract the seal bars 8, 9, a decompression valve 34 may be manually operated as described above, whereby a depressurization results in the stroke device 20. Thus, the seal bars 8, 9 are retracted and the wall element 1 can easily be slid or rolled along the support track 2.

Because both seal bars 8 and 9 are movable relative to the wall element 1 and are actuated to be pressed upwards and downwards respectively, it is not necessary to lift the entire wall element by means of the stroke device 20 pressing against the floor seal bar 9. Rather, it is possible to achieve an effective seal and a propping effect with a relatively low pneumatic pressure. Most of the weight of the wall element 1 remains hanging on the carriages 3.

Many other specific embodiments are possible according to the present invention. For example, the stroke device 20 may comprise a commonly available pneumatic piston cylinder device instead of the pneumatic bellows 22 for achieving a vertical stroke motion of the seal bars 8, 9 by applying pressurized air. Furthermore, it is possible to provide a separate bellows or piston cylinder device or other pneumatic device providing a vertical force for each of the two seal bars 8 and 9. In such an arrangement, each of the two pneumatic stroke devices is connected to a common pressure line 36, and the two-part linkage 16; 16' is unnecessary or can be simplified.

According to another variant of the invention, it is possible to arrange each wall element 1 either separately or in groups in any desired position within a room, independently of the wall connection jamb. Thus, the wall elements can be propped in any desired position in the room, for example, without adjoining a wall. In this case, it is simply necessary to connect a long pressure hose or a mobile compressed air source to a coupling valve member 32, for example.

Although the invention has been described with reference to specific example embodiments, it will be appreciated that it is intended to cover all modifications and equivalents within the scope of the appended claims.

What is claimed is:

1. A wall element for a mobile partition wall to be arranged on a support track, the wall element comprising a wall element body, an upper seal member arranged vertically movably relative to said wall element body along a top edge of said wall element body, a lower seal member arranged vertically movably relative to said wall element body along a bottom edge of said wall element body, at least one pneumatic stroke device cooperating with said upper and lower seal members to apply a vertically directed force to said seal members, first and second pneumatic couplings respectively arranged at first and second side edges of said wall element body, and a manually operable decompression valve pneumatically connected to said stroke device, wherein said first and second couplings and said pneumatic stroke device are pneumatically interconnected, and wherein at least said first coupling comprises a pneumatic valve.

2. The wall element of claim 1, comprising only one said stroke device and further comprising a two-part rod linkage that is arranged within said wall element body and that comprises first and second rods respectively connecting said stroke device with said seal members, wherein said stroke device drives said first and second rods in opposite directions when said stroke device is pneumatically actuated.

3. The wall element of claim 2, wherein said stroke device comprises a pneumatic bellows made of a flexible material, wherein opposite end faces of said bellows (22) cooperate with said two-part rod linkage, and wherein said linkage further comprises at least one return spring arranged to retract said bellows and said seal members.

4. The wall element of claim 3, wherein said stroke device further comprises a cup-shaped housing within which said bellows is arranged, wherein said wall element body comprises rigid horizontal frame members, wherein said two-part rod linkage further comprises stops arranged on said rods, and wherein said at least one return spring comprises compression springs braced against said frame members and acting on said stops.

5. The wall element of claim 1, wherein said pneumatic valve comprises a non-return valve.

6. The wall element of claim 1, wherein said pneumatic valve comprises a poppet-type valve, and wherein said second coupling comprises a coupling bolt configured to cooperate with said poppet-type valve to open said valve when said first and second couplings of two adjacent ones of said wall elements are pushed into coupling engagement, and wherein said poppet-type valve is closed when said first and second couplings are not in coupling engagement.

7. The wall element of claim 1, further comprising a support carriage for engaging and riding along said track, said carriage comprising a carriage body, and a riding element selected from the group consisting of a roller wheel and a roller ball.

8. The wall element of claim 1, wherein said wall element body comprises a vertical frame member at each of said first and second side edges, a horizontal frame member at each of said top and bottom edges, and two wall panels attached to at least two of said frame members to form a wall surface on each side of said wall element and to enclose a hollow space within said wall element, and wherein said pneumatic stroke device is arranged in said hollow space.

9. A wall element for a mobile partition wall to be arranged on a support track, the wall element comprising a wall element body, an upper seal member arranged vertically movably relative to said wall element body along a top edge of said wall element body, a lower seal member arranged vertically movably relative to said wall element body along a bottom edge of said wall element body, at least one pneumatic stroke device cooperating with said upper and lower seal members to apply a vertically directed force to said seal members, first and second pneumatic couplings respectively arranged at first and second side edges of said wall element body, wherein said first and second couplings and said pneumatic stroke device are pneumatically interconnected, wherein at least said first coupling comprises a pneumatic poppet-type valve, wherein said second coupling comprises a coupling bolt configured to cooperate with said poppet-type valve to open said valve when said first and second couplings of two adjacent ones of said wall elements are pushed into coupling engagement, a bias spring urging said coupling bolt outwardly relative to said wall element, and a decoupling arm connected to said coupling bolt, and wherein said decoupling arm is manually operable to pull said bolt inwardly and out of coupling engagement with said poppet-type valve of said first coupling.

10. A mobile partition wall comprising a support track mounted on the ceiling of a room and a plurality of wall elements, wherein each of said wall elements comprises a wall element body, an upper seal member arranged vertically movably relative to said wall element body along a top edge of said wall element body, a lower seal member arranged vertically movably relative to said wall element body along a bottom edge of said wall element body, at least one pneumatic stroke device cooperating with said upper and lower seal members to apply a vertically directed force to said seal members, first and second pneumatic couplings respectively arranged at first and second side edges of said wall element body, and a manually operable decompression valve pneumatically connected to said stroke device, wherein said first and second couplings and said pneumatic stroke device are pneumatically interconnected, and wherein at least said first coupling comprises a pneumatic valve, each of said wall elements further comprising a support carriage for engaging and riding along said track, said carriage comprising a carriage body and a riding element selected from the group consisting of a roller wheel and a roller ball.

11. The mobile partition wall of claim 10, wherein said first coupling further comprises a first tapering surface member arranged around said pneumatic valve, and wherein said second coupling comprises a coupling bolt adapted to cooperate with said pneumatic valve when said first and second couplings of two adjacent ones of said wall elements are in coupling engagement, a bias spring urging said coupling bolt outwardly relative to said wall element body, and a second tapering surface member having a shape adapted to mate with said first tapering surface member when said first and second couplings of two adjacent ones of said wall elements are in coupling engagement.

12. The mobile partition wall of claim 11, wherein said first tapering surface member is a member having a female circular conical surface and said second tapering surface member is a member having a male circular conical surface.

* * * * *